United States Patent [19]

Henson

[11] Patent Number: 4,494,802

[45] Date of Patent: Jan. 22, 1985

[54] SLIDE ARRANGEMENT

[76] Inventor: Richard L. Henson, 1200 N. Everette, Glendale, Calif. 91207

[21] Appl. No.: 488,031

[22] Filed: Apr. 25, 1983

[51] Int. Cl.[3] ..... F16C 29/04

[52] U.S. Cl. ..... 308/3.8

[58] Field of Search ..... 308/3.8, 6 R, DIG. 7; 312/350; 16/24, DIG. 35

[56] References Cited

U.S. PATENT DOCUMENTS

| | | | |
|---|---|---|---|
| 429,657 | 6/1890 | Spivey | 16/24 |
| 665,219 | 1/1901 | Hock | 16/24 |
| 1,542,231 | 6/1925 | Garfield | 16/24 |
| 2,995,405 | 8/1961 | Ferdig | 308/DIG. 7 |
| 3,197,842 | 8/1965 | Parker | 308/DIG. 7 |
| 4,062,251 | 12/1977 | Parsons | 308/6 R |
| 4,382,637 | 5/1983 | Blackburn et al. | 308/6 R |

*Primary Examiner*—Lenard A. Footland
*Attorney, Agent, or Firm*—Don B. Finkelstein

[57] ABSTRACT

An improved slide arrangement for mounting between the bottom edge of a drawer and the drawer support. The bearing member formed of sheet material having a coefficient of friction less than 0.25 and having a plurality of bearing sockets. The bearing sockets formed by molding, drilling or perforating the bearing member. A laser can also be used to carve the bearing sockets. A roller or ball bearing is inserted into each socket molded or carved to a preselected size and shape thereby holding the bearing in place. A bearing is placed within each drilled or perforated socket and each socket edge is punched to form a flange around the edge of each socket thereby holding the bearing in place. A reinforcing member formed of sheet material having a coefficient of friction less than 0.25 can be applied to the longitudinal edge of the drawer to present a resilient working edge with a low coefficient of friction to the ball or roller bearings.

22 Claims, 6 Drawing Figures

FIG. 1
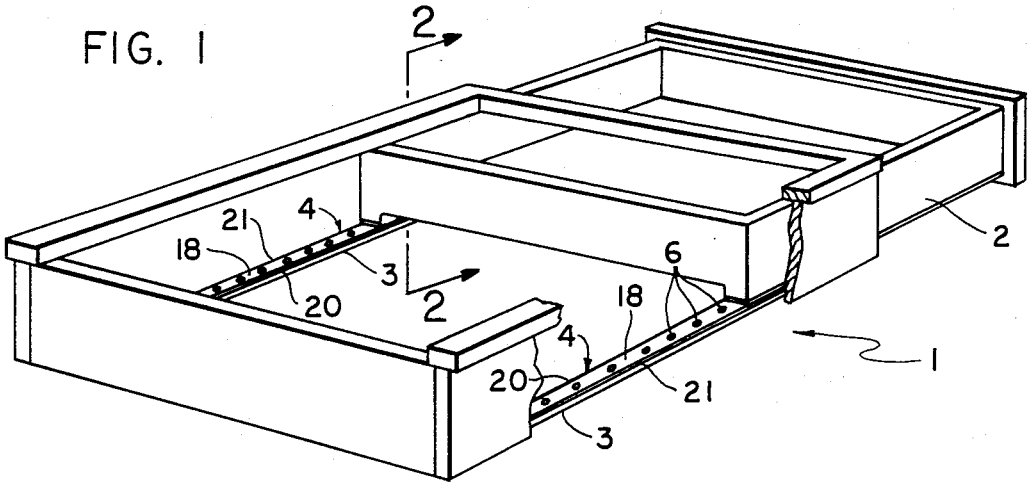
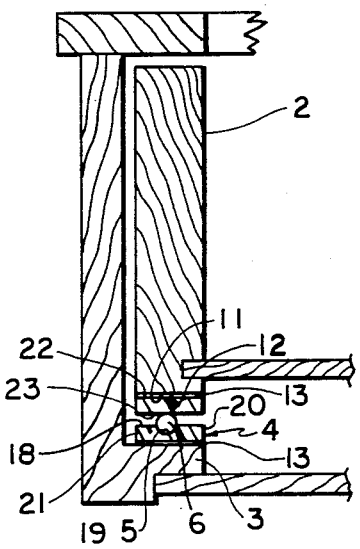
FIG. 2
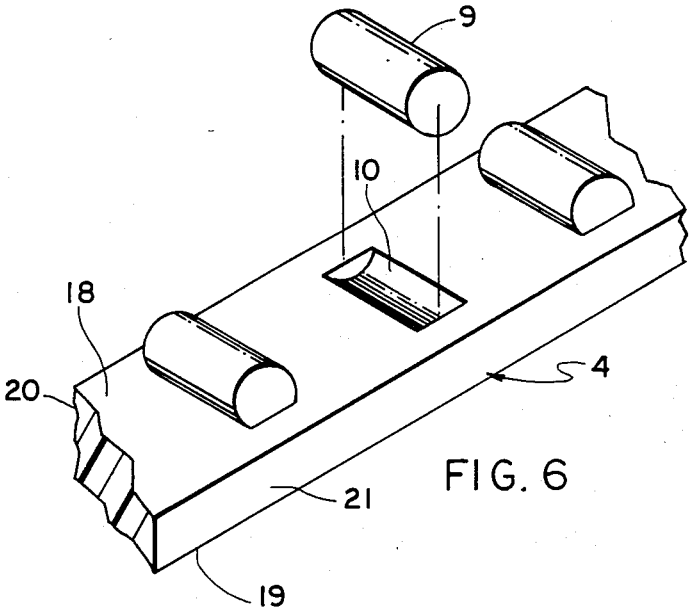
FIG. 6
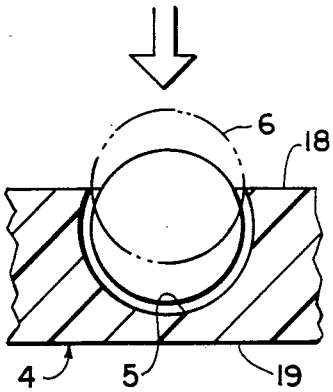
FIG. 3
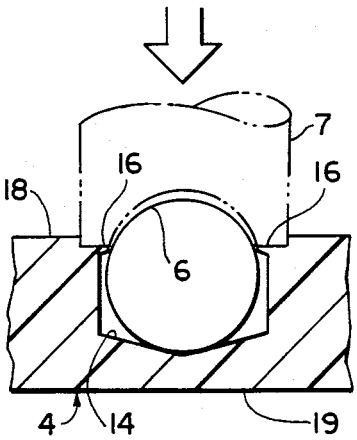
FIG. 4
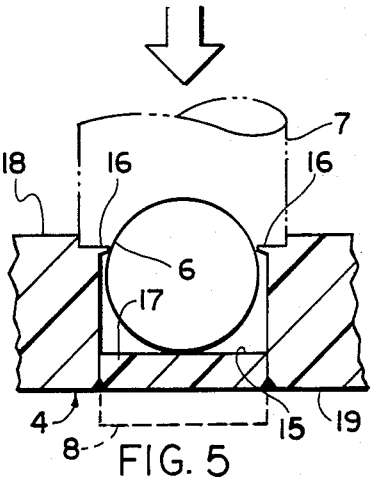
FIG. 5

SLIDE ARRANGEMENT

TECHNICAL FIELD

This invention relates to the slide arrangement for drawers and the like and, more particularly, to an improved slide arrangement utilizing sheet material having a low coefficient of friction and bearings.

BACKGROUND ART

Slide arrangements have been known for many years. Most of the devices have utilized various configurations to minimize the friction between the drawer and the drawer support.

In the prior art the slide arrangements have used rolling type bearing such as ball bearings as the primary method of reducing friction. Ball bearings were held in various socket arrangements. The socket arrangements being usually constructed of metal, resulting in a metal-to-metal contact between the socket and the ball. The supporting portion of the ball that projected from the socket would work against various arrangements. These arrangements included working against the drawer bottom or against the drawer support. However, the most common arrangement was to have the ball bearing work against a metal surface that was either flat or curved to provide a track for the bearing arrangement. Again, this still resulted in metal working against metal. Although this improved the function of the drawer in that it reduced friction, it required subsequent lubrication to be added to reduce the metal-to-metal friction. The lubrication, over time, would collect contaminants such as dust and require removal and replacement other prior art arrangements have utilized rolling type bearings such as roller bearings in similar structures and having similar disadvantages. Other slide arrangements placed the bearings inside of a wheel arrangement whereby the bearings, with their lubrication, would be separate and apart from the drawer or drawer support. This improved the problem of a greasy slide that would collect contaminants but did not entirely eliminate the problem. Further, such arrangements were usually designed to be mounted on the sides of the drawers thus reducing the usable width of the drawer opening. If sealed bearings are used to eliminate contamination of lubricated bearings in this type of arrangement, the cost effectiveness of such an arrangement became an issue.

Thus, there has long been a need for a slide arrangement which utilized a material to form the sockets for the bearings as well as provide a surface against which the bearings work that is "self lubricating". The self lubricating characteristic of the material can be supplied by choosing a material that has a characteristically low coefficient of friction.

DISCLOSURE OF INVENTION

Accordingly it is an objective of this invention to provide a novel and improved bearing device for slidably supporting objects such as drawers or the like, for movement by the supported object across a stationary surface. A further object of the invention is to provide a structure that is easy to install, provides great smoothness of operation, and involves simple components.

It is a further object of this invention to provide a slide arrangement that does not require lubrication for continued smooth operation and thus does not collect contaminants.

These and other objectives are achieved by utilizing sheet material that has a characteristically low coefficient of friction such as acetal which is available under trademark names Celcon or Delrin, polytetrafluoroethylene which is available under the trademark name Teflon, or nylon. These sheet materials are easily shaped by molding, drilling, perforating, trimming, or punching.

These sheet materials can be molded around double curved surfaces and because of their slightly elastic quality, can be removed from such double curved surfaces without damaging or deforming the material. These sheet materials have unusually low moisture absorption so that they will not deform and bind the drawer slide arrangement due to expansion. These materials have great strength, stiffness and toughness making them particularly suitable for use in sheet form as a bearing support and working surface reinforcement. Further, the low coefficient of friction of these materials make them ideal as they provide a slippery "self lubricated" surface to the bearings without the necessity for adding lubrication to the arrangement.

The bearing member of the arrangement is formed as an elongated strip of sheet material with two side opposing surfaces approximately as wide as the drawer support. The sheet material having a second pair of top and bottom opposing surfaces being of a thickness to allow the bearing member to be provided with a series of rolling type bearing such as ball bearings or roller bearings that are deposited receiving sockets formed by first walls accessible through the second of the opposing surfaces of the elongated section of self lubricating sheet material that has a low coefficient of friction. The first of the opposing top and bottom surfaces of this sheet material can be attached to the drawer support member by suitable means such as an adhesive. When so attached to the drawer support member the longitudinal edge of the drawer is then supported by the ball or roller bearings of the slide arrangement. If the longitudinal edge of the drawer is constructed of a soft wood, it may be desirable to attach a reinforcing member composed of a second elongated strip of sheet material having a third pair of opposing top and bottom surfaces to the bottom of the longitudinal edge of the drawer. This reinforcing member attached by one of the third opposing surfaces will then present the other of the third opposing surfaces as a working edge that is supported by the bearings. In addition to providing a working edge, the reinforcing member supplies a smooth "self lubricated" surface to the ball or roller bearings.

The receiving sockets in the bearing member may be formed in several ways. One method is to mold the first walls in the sheet material to form the receiving sockets accessible through the second of the opposing surfaces. The size of the receiving sockets should be larger than the bearings. Because of the slightly elastic nature of the sheet material, the receiving socket may be molded to be more than 50% of a sphere for a ball bearing or more than 50% of a reclined cylinder for a roller bearing. However, as the sheet material is only slightly elastic, the molded socket should be less than 80% of the bearing to avoid deformation of the socket upon removal from the mold. The elastic nature also allows a ball bearing or roller bearing to be inserted into the receiving socket without damaging or deforming the molded socket. The receiving socket may also be formed by carving portions of the sheet material by a beam of intensity and directionally controlled coherent light from a laser.

The receiving socket may also be formed by drilling partially through the sheet material, starting at the second of the opposing surfaces, to form a drilled socket with vertical sides. The tip of the drill may be chosen to be the conventional "v" shaped or may be rounded to nearly conform to the shape of the ball bearing.

Another method for forming the receiving socket for either the ball bearing or the roller bearing is to perforate the sheet material. The form of the performation would be circular for the ball bearing and rectangular for the roller bearing. The perforation process creates a removable section of the material or chaff that would be cylindrical for the ball bearing and block shaped for the roller bearing. This chaff may be partially removed, trimmed, and the remaining portion sealed flush to the first of the opposing surfaces of the sheet material, thus forming a perforated socket.

After forming either the drilled socket or the perforated socket, the selected bearing may be placed into the socket. The bearing is maintained within the socket by punching the second of the opposing surfaces of the sheet material around the drilled or perforated socket edge, such that the sheet material is deformed near this second of the opposing surfaces around the part of the bearing not enclosed within the socket, thereby creating a flange to hold the bearing within the socket.

A better understanding will become apparent from the following detailed description taken in conjunction with the accompanying drawings, with like referenced characters denoting corresponding parts therein.

BRIEF DESCRIPTION OF THE DRAWINGS

FIG. 1 represents a pictorial diagram of a drawer slide arrangement between a drawer and drawer support.

FIG. 2 shows a sectional view of the drawer and drawer support with the slide arrangement disposed between them.

FIG. 3 shows a sectional view of a molded ball receiving socket depicting the ball being inserted into the socket.

FIG. 4 shows a sectional view of a drilled socket with the ball in place and punch deforming the socket.

FIG. 5 shows a perforated socket with the chaff trimmed and sealed, the ball inserted and the punch deforming the perforated socket.

FIG. 6 is a pictorial view of the sheet material with roller bearings inserted.

BEST MODE FOR CARRYING OUT THE INVENTION

With reference to the drawings, in FIG. 1, the drawer slide arrangement 1 is made up of the drawer 2, the drawer support 3 with the slide arrangement 1 disposed between the drawer 2 and drawer support 3. FIG. 1 depicts how the slide arrangement is made up of an elongated bearing member 4 formed of sheet material having a low coefficient of friction such as acetal, polytetrafluoroethylene or nylon which rests on the drawer support 3. The elongated bearing member 4 has a number of balls 6 placed periodically along its length.

The coefficient of friction of acetal is 0.08 to 0.15. The coefficient of friction of polytetrafluoroetheylene (TEF) is 0.02 to 0.1. The coefficient of friction of nylon is 0.15 to 0.25. Other materials are known in the art that have a coefficient of less than 0.25. Though TEF has the lowest coefficient of friction, the performance of acetal in the slide arrangement 1 is adequate and produces a product that is cost effective. Nylon will function in the slide arrangement 1, but its coefficient of friction presents the functional upper bound for use in this invention.

The elongated bearing member 4 has a first pair of opposing surfaces 20 and 21 that are approximately the width of the drawer support 3. The exact width is not crucial. The second pair of opposing surfaces 18, 19 are approximately the thickness of a rolling type bearing such as the balls 6 of FIG. 1 or the roller bearing 9 of FIG. 6 engaged in the bearing member 4. The exact thickness is not critical. The cross section of the drawer slide arrangement in FIG. 2 depicts how the elongated bearing member 4 contains ball receiving sockets 5 placed periodically along the length of the surface 18. The ball receiving socket 5 contains a ball 6. The ball receiving socket 5 is of a preselected depth to allow the ball 6 to protrude above the surface 18 of the elongated bearing member 4 so that the longitudinal edge 11 of the drawer 2 is supported by the ball 6 a preselected distance from the elongated bearing member 4. If the longitudinal edge 11 of the drawer 2 is constructed of a soft wood that may dent or deteriorate due to wear while being supported by the balls 6, a reinforcing member 12 formed of a second elongated strip of sheet material having a third pair of opposing surfaces 22, 23 may be attached to the longitudinal edge 11 to provide a strong, resiliant, working edge for the drawer 2. Because of the low coefficient of friction of the sheet material, this reinforcing member 12 further adds to the "self lubricated" function of the slide arrangement 1.

Adhesives are well known in the art, and an appropriate adhesive 13 as shown in FIG. 2 can be selected to attach the surface 19 of the elongated bearing member 4 to the drawer support 3. The same adhesive 13 can be utilized to attach surface 22 of the reinforcing member 12 to the longitudinal edge 11 of the drawer 2. This adhesive could be applied before the members are attached or could be in the form of a strip of adhesive already bound to the selected surface of the members requiring only the removal of a backing sheet to expose the adhesive just before the member is attached. The selection of the adhesive will depend mainly upon marketing factors and anticipated shelf life of the adhesives.

FIG. 3 depicts the elongated bearing member 4 and a ball receiving socket 5. The receiving socket 5 is a preselected percentage of a sphere, the percentage being greater than 50%, but less than 80%, the present invention uses 68.18% of the sphere that forms the socket, but the exact figure is not critical. The major consideration is to select a size that does not result in deformation of the socket 5 upon formation of the socket 5 or insertion of the ball 6. This type of socket 5 can be formed by molding the sheet material over a form of the preselected percentage of a sphere that has a diameter 5% to 25% larger than the diameter of a ball 6. The present invention uses 18.75%. This type of socket 5 can also be formed by carving the sheet material with a beam of coherent light from a laser. The intensity and direction of the beam can be controlled to carve a socket 5 of the preselected size and shape. The slightly elastic quality of the sheet material allows the sheet material to be removed from the mold of the double curved surface of the preselected form and will allow the ball 6 to be inserted into the socket 5 and then maintain the ball 6 within the socket 5 without deforming the molded ball receiving socket 5.

FIG. 6 depicts the elongated bearing member 4 with a plurality of roller bearings 9 placed periodically along its length and held in place by roller bearing receiving sockets 10. The roller bearing receiving socket 10 can be formed in the same manner as above. The roller bearing receiving socket 10 is a preselected percentage of a roller bearing, the percentage being greater than 50% but less than 80%. The exact figure is not critical. The major consideration is to select a size that does not result in deformation of the roller bearing receiving socket 10 upon formation of the roller bearing receiving socket 10 or insertion of the roller bearing 9. When molding the roller bearing socket 10 over a form of a preselected percentage of a roller bearing 9, the form should have a diameter 5 to 25% larger than the diameter of the roller bearing 9 and a length 5 to 25% larger than the length of the roller bearing 9.

FIG. 4 depicts the formation of the socket by first drilling the sheet material through surface 18 to a preselected depth forming a drilled socket 14. The ball 6 is then placed inside the drilled socket 14 and the surface 18 of the elongated bearing member 4 is deformed with a punch 7 to create the flange 16 thereby maintaining the ball within the drilled socket 14. The tip of the drill used in forming 17 the drill socket 14 depicted in FIG. 4 has the typical drill bit on the face of the drill set at an obtuse angle. An approximation of the receiving socket 5 depicted in FIG. 3 can be achieved by the drilling method by choosing a drill bit formed with a rounded tip having a preselected radius and comprising a preselected percentage of a sphere rather than set at an obtuse angle. The diameter of the drill bit should be 5% to 25% larger than the diameter of the ball 6. If a rounded tip bit is used, the tip should approximate 50% of a sphere. The depth of the drilling in the elongated bearing member 4 is selected so that greater than 50% but less than 80% of the ball 6 is maintained within the socket 5. The exact figure of how much of the ball 6 is retained in the socket is not critical.

FIG. 5 depicts the formation of the socket by first perforating the elongated bearing member 4 from one of the opposed surfaces 18, 19 to the other of the opposed surfaces 18, 19. The perforation process depicted creates a removable section of material or chaff 17, 8. The chaff 17, 8 is removed a preselected length. The removed portion of the chaff 8 is trimmed and the remaining portion of the chaff 17 is sealed flush to the first of the opposing surfaces 19 of the elongated bearing member 4 creating a perforated socket 15.

The size and shape of the tool used to perforate the elongated bearing member 4 depends on the choice of bearing. If a ball 6 is to be used as the bearing, the perforating tool should be circular and have an outside diameter 5 to 25% larger than the diameter of the ball 6. This tool will produce a cylindrical chaff 17, 8.

If a roller bearing is to be used as depicted in FIG. 6, the perforating tool would be rectangular in shape with the length 5 to 25% larger than the length of the roller bearing 9 and a width 5 to 25% larger than the diameter of the roller bearing 9. The chaff 17, 8 created by this perforation is block shaped and should be removed a preselected distance so that after the removed portions of the chaff 8 is trimmed and the remaining portions of the chaff 17 is sealed flush to the surface 19 of the bearing member 4 the perforated socket 15 created thereby should have a depth greater than 50% but less than 80% of the diameter of the roller bearing 9. The exact figure is not critical.

After the perforated socket 15 is created for either a ball 6 or a roller bearing 9, the bearing can be placed within the perforated socket 15 and surface 18 of the elongated bearing member 4 is deformed with a punch 7 to create the flange 16 thereby maintaining the selected bearing within the perforated socket 15.

Thus, there has been described specific steps for creating a slide arrangement for drawers and the like. Those skilled in the art will recognize other methodology for creating such an arrangement described more particularly by the claims that follow.

What is claimed is:

1. A slide arrangement that rests upon a support for a drawer or the like comprising:

an elongated bearing member having a pair of opposed surfaces, the bearing member formed of sheet material having a coefficient of friction of less than 0.25 being fixedly mounted by the first of the opposed surfaces to the support for the drawer;

first walls forming a plurality of ball receiving sockets in general alignment along the length of and accessible through the second of the opposed surfaces; and balls engaged within the ball receiving sockets, the balls disposed to support the bottom longitudinal edge of the drawer a preselected distance from the bearing member.

2. A slide arrangement in accordance with claim 1 wherein the ball receiving sockets are formed by molding the sheet material in a form wherein the first walls are formed to have a preselected inside diameter comprising a preselected percentage of a sphere being accessible for ball receiving.

3. A slide arrangement in accordance with claim 1 wherein the ball receiving sockets are formed by drilling partially through the bearing member from the second of the opposed surfaces, placing the balls within the drilled sockets and punching the second of the opposed surfaces around the edge of each drilled socket so that a portion of the drilled socket nearest the second of the opposed surfaces forms a flange thereby holding the ball within the drilled socket.

4. A slide arrangement in accordance with claim 3 wherein the drill bit used to form the drilled sockets has a rounded tip, having a preselected radius and comprising a preselected percentage of a sphere.

5. A slide arrangement in accordance with claim 1 wherein the ball receiving sockets are formed by: perforating the bearing member from one of the opposed surfaces to the other thereby creating a cylindrical chaff; partially removing the chaff a preselected length through one of the opposed surfaces; trimming the removable portion of the chaff; sealing the remaining portion of the chaff flush with the first of the opposed surfaces thereby creating a perforated socket accessible through the second of the opposed surfaces; and then placing the balls within the perforated sockets and punching the second of the opposed surfaces around the edge of each perforated socket so that a portion of the perforated socket nearest the second of the opposed surfaces forms a flange thereby holding the ball within the perforated socket.

6. A slide arrangement in accordance with claim 1 wherein the ball receiving sockets are formed by exposing the second of the opposing surfaces to a beam of coherent light, the intensity, duration and direction of the coherent light being controlled such that the first walls are carved to have a preselected inside diameter comprising a preselected percentage of a sphere being accessible for ball receiving.

7. A slide arrangement that rests upon a support for a drawer or the like comprising:

an elongated bearing member having a pair of opposed surfaces, the bearing member formed of sheet material having a coefficient of friction of less than 0.25 being fixedly mounted by the first of the opposed surfaces to the support for the drawer;

first walls forming a plurality of ball receiving sockets in general alignment along the length of and accessible through the second of the opposed surfaces;

balls engaged within the ball receiving sockets, the balls disposed to support the bottom longitudinal edge of the drawer a preselected distance from the bearing member; and an elongated reinforcing member having a third pair of opposed surfaces, the reinforcing member formed of sheet material having a coefficient of friction of less than 0.25 being fixedly mounted by one of the third pair of opposing surfaces to the bottom longitudinal edge of the drawer such that the other of the third pair of opposing surfaces is supported by the balls a preselected distance above the bearing member.

8. A slide arrangement in accordance with claim 7 wherein the ball receiving sockets are formed by molding the sheet material in a form wherein the first walls are formed to have a preselected inside diameter comprising a preselected percentage of sphere being accessible for ball receiving.

9. A slide arrangement in accordance with claim 7 wherein the ball receiving sockets are formed by drilling partially through the bearing member from the second of the opposed surfaces, placing the balls within the drilled sockets and punching the second of the opposed surfaces around the edge of each drilled socket so that a portion of the drilled socket nearest the second of the opposed surfaces.

10. A slide arrangement in accordance with claim 9 wherein the drill bit used to form the drilled sockets has a rounded tip, having a preselected radius and comprising a preselected percentage of a sphere.

11. A slide arrangement in accordance with claim 7 wherein the ball receiving sockets are formed by: perforating the bearing member from one of the opposed surfaces to the other thereby creating a cylindrical chaff; partially removing the chaff a preselected length through one of the opposed surfaces; trimming the removed portion of the chaff sealing the remaining portion of the chaff flush with the first of the opposed surfaces thereby creating a perforated socket accessible through the second of the opposed surfaces; and then placing the balls within the perforated sockets and punching the second of the opposed surfaces around the edge of each perforated socket so that a portion of the perforated socket nearest the second of the opposed surfaces forms a flange thereby holding the ball within the perforated socket.

12. A slide arrangement in accordance with claim 7 wherein the ball receiving sockets are formed by exposing the second of the opposing surfaces to a beam of coherent light, the intensity, duration and direction of the coherent light being controlled such that the first walls are carved to have a preselected inside diameter comprising a preselected percentage of a sphere being accessible for ball receiving.

13. A slide arrangement that rests upon a support for a drawer or the like comprising:

an elongated bearing member having a pair of opposed surfaces, the bearing member formed of sheet material having a coefficient of friction of less than 0.25 being fixedly mounted by the first of the opposed surfaces to the support for the drawer;

first walls forming a plurality of rolling type bearing receiving sockets in general alignment along the length of and accessible through the second of the opposed surfaces; and rolling type bearings engaged within the rolling type bearing receiving sockets, the rolling type bearings disposed to support the bottom longitudinal edge of the drawer a preselected distance from the bearing member.

14. The arrangement defined in claim 13 wherein:

said rolling type bearings comprise roller bearings; and said rolling type bearing receiving sockets comprise roller bearing receiving sockets.

15. A slide arrangement in accordance with claim 14 wherein the roller bearing receiving sockets are formed by exposing the second of the opposing surfaces to a beam of coherent light, the intensity, duration and direction of the coherent light being controlled such that the first walls are carved to have a preselected inside cylindrical diameter and length comprising a preselected percentage of a cylinder being accessible for roller bearing receiving.

16. A slide arrangement in accordance with claim 14 wherein the roller bearing receiving sockets are formed by: perforating the bearing member from one of the opposed surfaces to the other thereby creating a block shaped chaff; partially removing the chaff a preselected length through one of the opposed surfaces; trimming removed portion of the chaff; sealing the remaining portion of the chaff flush with the first of the opposed surfaces thereby creating a perforated socket accessible through the second of the opposed surfaces; and then placing the roller bearings within the perforated sockets and punching the second of the opposed surfaces around the edge of each perforated socket so that a portion of the perforated socket nearest the second of the opposed surfaces forms a flange thereby holding the roller bearing within the perforated socket.

17. A slide arrangement in accordance with claim 14 wherein the roller bearing receiving sockets are formed by molding the sheet material in a form wherein the first walls are formed to have a preselected inside cylindrical diameter and length comprising a preselected percentage of a cylinder being accessible for roller bearing receiving.

18. The arrangement defined in claim 13 and further comprising:

an elongated reinforcing member having a third pair of opposed surfaces, the reinforcing member formed of sheet material having a coefficient of friction of less than 0.25 being fixedly mounted by one of the third pair of opposing surfaces to the bottom longitudinal edge of the drawer such that the other of the third pair of opposing surfaces is supported by the rolling type bearings a preselected distance from the bearing member.

19. The arrangement defined in claim 18 wherein:

said rolling type bearings comprise roller bearings;

said rolling type bearing receiving sockets comprise roller bearing receiving sockets.

20. A slide arrangement in accordance with claim 19 wherein the roller bearing receiving sockets are formed by perforating the bearing member from one of the opposed surfaces to the other thereby creating a block shaped chaff; partially removing the chaff a preselected length through one of the opposed surfaces; trimming the removed portion of the chaff; sealing the remaining portion of the chaff flush with the first of the opposed surfaces thereby creating a perforated socket accessible through the second of the opposed surfaces; and then placing the roller bearings within the perforated sockets and punching the second of the opposed surfaces around the edge of each perforated socket so that a portion of the perforated socket nearest the second of the opposed surfaces forms a flange thereby holding the roller bearing within the perforated socket.

21. A slide arrangement in accordance with claim 19 wherein the roller bearing receiving sockets are formed by exposing the second of the opposing surfaces to a beam of coherent light, the intensity, duration and direction of the coherent light being controlled such that the first walls are carved to have a preselected inside cylindrical diameter and length comprising a preselected percentage of a cylinder being accessible for roller bearing receiving.

22. A slide arrangement in accordance with claim 19 wherein the roller bearing receiving sockets are formed by molding the sheet material in a form wherein the first walls are formed to have a preselected inside cylindrical diameter and length comprising a preselected percentage of a cylinder being accessible for roller bearing receiving.

* * * * *